United States Patent [19]

Clarke

[11] 4,124,060

[45] Nov. 7, 1978

[54] ROTOR

[75] Inventor: John M. Clarke, Banbury, England

[73] Assignee: Caterpillar Tractor Co., Peoria, Ill.

[21] Appl. No.: 602,438

[22] Filed: Aug. 6, 1975

[30] Foreign Application Priority Data

Aug. 6, 1974 [GB] United Kingdom ..... 34693/74

[51] Int. Cl.[2] ..... F01C 21/06

[52] U.S. Cl. ..... 418/94; 165/142; 165/86; 123/41.34

[58] Field of Search ..... 123/8.01, 41.4, 41.41, 123/41.31, 41.34; 418/94, 91, 53, 68; 165/142, 47.1, 86; 219/120

[56] References Cited

U.S. PATENT DOCUMENTS

| | | | |
|---|---|---|---|
| 698,474 | 4/1902 | Ebbs | 123/41.41 |
| 723,000 | 3/1903 | Marsden | 418/94 |
| 1,098,440 | 6/1914 | Hicks | 418/94 |
| 1,280,668 | 10/1918 | Conklin | 418/91 |
| 2,351,230 | 6/1944 | Powell | 165/142 |
| 2,388,587 | 11/1945 | Wilson | 165/142 |
| 2,446,932 | 8/1948 | Johnson | 219/120 |
| 2,502,876 | 4/1950 | Mullen | 219/120 |
| 3,090,433 | 5/1963 | Amorosi | 165/142 |
| 3,229,673 | 1/1966 | Ehrhardt | 418/94 |
| 3,305,600 | 2/1967 | Hopper | 165/142 |
| 3,319,709 | 5/1967 | Strunk | 165/142 |
| 3,368,546 | 2/1968 | Wade | 165/142 |
| 3,403,726 | 10/1968 | Jones | 165/142 |
| 3,446,277 | 5/1969 | White | 165/142 |
| 3,539,280 | 11/1970 | Ravera | 418/91 |
| 3,566,957 | 3/1971 | Bridegum | 165/142 |
| 3,590,790 | 7/1971 | Keylwert | 123/8.01 |
| 3,674,248 | 7/1972 | Shellenberger | 165/142 |
| 3,732,916 | 5/1973 | Cope | 165/142 |
| 3,941,523 | 3/1976 | Shin | 418/91 |

*Primary Examiner*—Charles J. Myhre
*Assistant Examiner*—Margaret A. LaTulip
*Attorney, Agent, or Firm*—Gifford, Chandler, VanOphem, Sheridan & Sprinkle

[57] ABSTRACT

Cooling a hot component such as a rotor of a rotary piston engine by passing a coolant liquid through a passageway defined between adjacent surfaces of the component and a plug inserted into a socket in the component, the plug being made of a material having greater thermal conductivity than that of the material from which the component is made and the cross-sectional area of the passageway being sufficiently small as to produce turbulent flow of the coolant through the passageway.

2 Claims, 3 Drawing Figures

ROTOR

BACKGROUND OF THE INVENTION

I. Field of the Invention

The invention relates to a method of and apparatus for the improvement of heat transfer from a hot component made of a material having a low thermal conductivity. The invention is particularly, but not exclusively, concerned with the cooling of a hot engine component.

II. Description of the Prior Art

It is common practice to circulate oil or other coolant through passages in or adjacent a hot component and to cool the coolant remotely from the hot component for example in a heat exchanger or to allow it to cool in a sump. Usually the flow of liquid coolant through the coolant passages is laminar. By designing the coolant passages for turbulent flow, an improved cooling effect can be achieved, but as the passage walls are necessarily of smaller surface area for turbulent flow than for laminar flow, high temperature gradients may be produced near the coolant passages. An object of the present invention is to design the coolant passages for turbulent flow and to provide for a higher rate of thermal conduction from the vicinity of the coolant passage walls in a component made from a material of comparatively low thermal conductivity.

SUMMARY OF THE PRESENT INVENTION

According to the invention, a method of cooling a hot component consists in passing a coolant liquid through a passageway defined between adjacent surfaces of the component and a plug inserted into a socket in the component, the plug being made of a material having greater thermal conductivity than that of the material from which the component is made and the cross-sectional area of the passageway being sufficiently small as to produce turbulent flow of said coolant therethrough.

The invention also provides apparatus for performing the foregoing method, the apparatus comprising said plug inserted into said socket in the component and defining therewith said passageway through which there is to be turbulent flow and means defining inlet and outlet ducts for circulating said coolant through the passageway.

DESCRIPTION OF THE DRAWINGS

One form of the apparatus is now described by way of example with reference to the accompanying diagrammatic drawings, in which.

DESCRIPTION OF A PREFERRED EMBODIMENT

Figure 1:
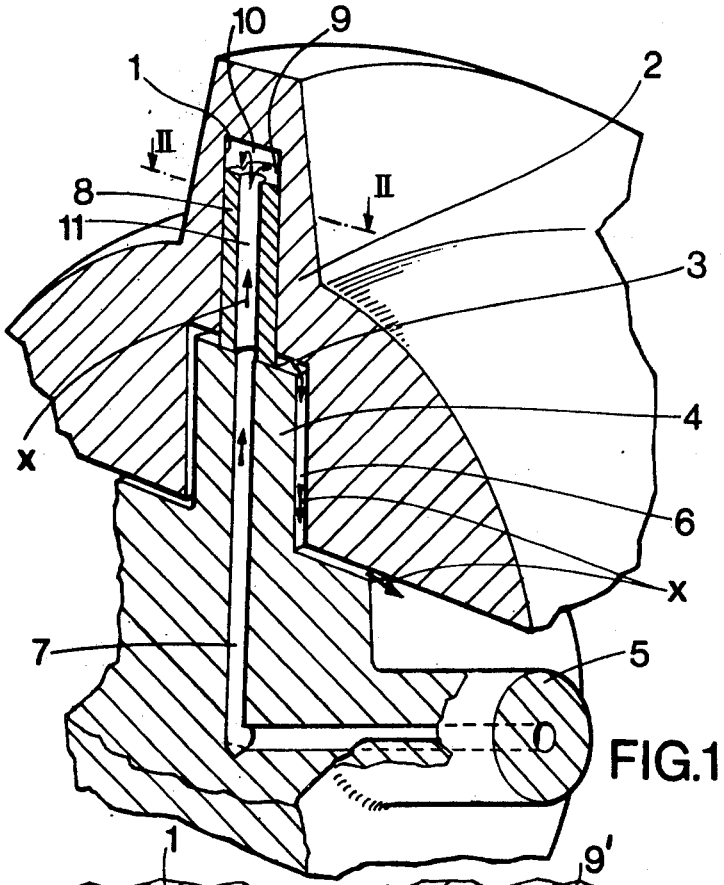
FIG. 1 is a perspective view having a sectioned front face of a portion of the rotor of a rotary piston engine provided with the aforesaid socket and plug.
Figure 2:
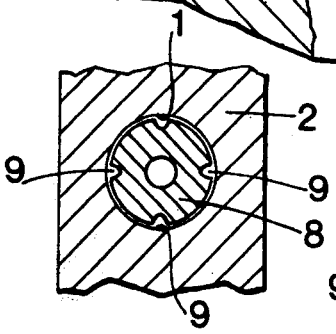
FIG. 2 is a section to a larger scale on the plane II—II in FIG. 1.

Referring first to FIGS. 1 and 2, a cylindrical socket 1 is formed in the rotor 2 and communicates with an annular groove 3 in which a swash-plate 4 is positioned. The swash-plate is mounted for rotation by a shaft 5 and, as is well-known, rotation of the swash-plate 4 effects angular oscillation of the rotor 2. A clearance passage 6 is provided between the swash-plate 4 and the rotor 2 and the swash-plate 4 is formed with an inlet duct 7 for the introduction to the periphery of the swash-plate of coolant liquid. The socket 1 contains a plug 8 which is fitted into the socket 2 with negligible peripheral clearance.

The plug 8 has several grooves 9 formed in its outer peripheral surface and these grooves cooperate with the internal wall of the socket 1 to define restricted passages communicating at the radially inner end of the plug with the clearance passage 6 and at the radially outer end of the plug with a space 10 between the outer end face of the plug 8 and the end wall of the socket 1 and through a bore 11 in the plug 8 to the coolant inlet duct 7 which communicates with the bore 11. Coolant is continuously circulated through the inlet duct 7, the bore 11, the space 10, the passages 9, in parallel, and the clearance passage 6 as shown by arrows X. Alternatively the flow of coolant may be in the reverse direction. The plug 8 is made of a material having considerably greater conductivity than that of the rotor 2, i.e., the component being cooled. The cross-sectional area of each passage 9 is such that the flow of coolant therethrough is tubulent. By achieving turbulent flow the heat transfer from the rotor 2 to the coolant is increased but as the wall surface area of the passages 9 is small due to the small flow area required to produce turbulent flow, the temperature gradient near the passages 9 is high. However by making the plug 8 from a material having high conductivity, the heat is readily dissipated.

Figure 3:
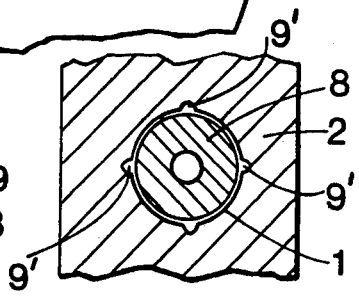
FIG. 3 is a view similar to FIG. 2 showing a modification.

The grooves could be formed in the socket wall 1 of the rotor 2, i.e., the component being cooled instead of in the plug 8, as shown in FIG. 3, at 9', or partly in the plug 8 and partly in the socket wall 1.

Turbulent flow is achieved by using a low viscosity oil as the coolant. The turbulent flow conditions permit flow velocities which will improve the heat transfer co-efficients. Where the coolant has a high Prandtel number, the cooling effect is increased for the same pressure drop by using turbulent flow instead of laminar flow.

Although, the form of apparatus described herein is particularly suitable for cooling the rotor 2 of a rotary piston engine as illustrated, the plug may be inserted into a socket in any other component suitable for cooling by the method provided by this invention.

Where the component being cooled, for example the rotor of a rotary piston engine, is made of nodular cast iron, the plug 8 would suitably be made of aluminum or copper.

What I claim as my invention and desire to secure by Letters Patent of the United States is:

1. A rotor of a rotary piston engine in which the rotor is cooled by apparatus comprising a socket having an open end and a closed end and being provided in the rotor, a plug inserted into said socket in the rotor and defining therewith a plurality of passageways, the cooling being effected by passing a coolant liquid through said passageways of which the cross-sectional area of each is sufficiently small as to produce turbulent flow of coolant liquid therethrough and by the plug being made of a material having greater thermal conductivity than that of the material from which the rotor is made, the apparatus also comprising means defining inlet and outlet ducts communicating with said passageways, the plug fitting in the socket with negligible peripheral clearance therebetween and provided with a bore defining one of said inlet and outlet ducts for said coolant liquid and extending between one end of the plug adjacent the open end of the socket and the other end of the plug which together with the closed end of the socket defines a chamber for said coolant liquid, each passageway being in the form of a longitudinally-extending groove of small flow area defined in at least one of the peripheral walls of the plug and the socket.

2. Apparatus for cooling a rotor of a rotary piston engine, the apparatus comprising said rotor having a socket therein, the socket having an open end and a closed end, a plug inserted into said socket in said rotor and defining therewith a plurality of passageways through which there is to be turbulent flow of coolant liquid and means defining inlet and outlet ducts communicating with said passageways, said plug being made of a material having greater thermal conductivity than that of the material from which said rotor is made, said plug fitting in said socket with negligible peripheral clearance therebetween and provided with a bore defining one of said inlet and outlet ducts for said coolant liquid and extending between one end of said plug adjacent the open end of said socket and the other end of said plug which together with the closed end of said socket defines a chamber for said coolant liquid, each passageway being in the form of a longitudinally-extending groove of small flow area defined in the peripheral wall of said plug, the flow area of each said groove being sufficiently small that the flow of coolant therethrough is turbulent.

* * * * *